US012331451B2

(12) United States Patent
Leibman et al.

(10) Patent No.: US 12,331,451 B2
(45) Date of Patent: Jun. 17, 2025

(54) DRYER APPLIANCE AND COMPARTMENT FOR NON-TUMBLING ITEMS

(71) Applicant: Haier US Appliance Solutions, Inc., Wilmington, DE (US)

(72) Inventors: Alexander B. Leibman, Prospect, KY (US); Venkata Chakradhar Rangu, Louisville, KY (US); Veera Venkata Anil Bhaskar Prasad Seereddy, Hyderabad (IN); Jason Meurer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 711 days.

(21) Appl. No.: 17/676,358

(22) Filed: Feb. 21, 2022

(65) Prior Publication Data

US 2023/0265596 A1 Aug. 24, 2023

(51) Int. Cl.

| | |
|---|---|
| ***D06F 58/04*** | (2006.01) |
| ***D06F 58/22*** | (2006.01) |
| ***D06F 58/26*** | (2006.01) |

(52) U.S. Cl.

CPC ..... *D06F 58/04* (2013.01); *D06F 58/22* (2013.01); *D06F 58/26* (2013.01)

(58) Field of Classification Search

CPC ..... D06F 58/22

See application file for complete search history.

(56) References Cited

U.S. PATENT DOCUMENTS

| | | | | |
|---|---|---|---|---|
| 2,817,157 | A * | 12/1957 | McCormick | D06F 58/02 34/82 |
| 2,843,945 | A * | 7/1958 | Whyte | D06F 58/02 34/601 |
| 2,903,799 | A * | 9/1959 | Sachaczenski | D06F 58/22 34/527 |
| 3,579,851 | A * | 5/1971 | Elmy | D06F 34/08 34/82 |
| 5,062,219 | A * | 11/1991 | Harris | F26B 11/028 34/609 |
| 7,913,419 | B2 | 3/2011 | Tomasi et al. | |
| 10,246,808 | B2 | 4/2019 | Bae et al. | |
| 10,731,285 | B2 | 8/2020 | Pieretti et al. | |
| 10,731,288 | B2 | 8/2020 | Hoffman et al. | |
| 10,738,407 | B2 | 8/2020 | Kehl et al. | |
| 10,774,453 | B2 | 9/2020 | Erickson et al. | |
| 10,774,462 | B2 | 9/2020 | Ayers et al. | |
| 10,793,985 | B2 | 10/2020 | Salinas Torres | |

(Continued)

FOREIGN PATENT DOCUMENTS

| | | |
|---|---|---|
| CN | 208562857 U | 3/2019 |
| KR | 101989889 B1 | 6/2019 |

*Primary Examiner* — David J Laux

(74) *Attorney, Agent, or Firm* — Dority & Manning, P.A.

(57) ABSTRACT

Exemplary dryer appliances are provided herein including a cabinet having an upper portion and a lower portion. A drum is rotatably mounted in the upper portion of the cabinet. A slideable first drawer housing a filter is mounted in the lower portion of the cabinet. A slideable second drawer is mounted below the drum. One or more fans circulates air through the drum, through the filter of the first drawer, and through the second drawer before the air is exhausted from the dryer appliance, providing drying of articles within both the drum and the second drawer.

20 Claims, 7 Drawing Sheets

(56) References Cited

U.S. PATENT DOCUMENTS

| | | | | |
|---|---|---|---|---|
| 10,793,989 | B2 | 10/2020 | Burgess et al. | |
| 10,815,597 | B2 | 10/2020 | Budicky et al. | |
| 10,815,605 | B2 | 10/2020 | Bueno et al. | |
| 10,815,607 | B2 | 10/2020 | Costa et al. | |
| 10,837,135 | B2 | 11/2020 | Hendrickson et al. | |
| 10,844,533 | B2 | 11/2020 | Benne et al. | |
| 10,907,288 | B1 | 2/2021 | Carpenter et al. | |
| 10,907,292 | B2 | 2/2021 | Harbrecht et al. | |
| 10,914,028 | B2 | 2/2021 | Gallagher et al. | |
| 10,982,374 | B2 | 4/2021 | Beres et al. | |
| 10,988,881 | B2 | 4/2021 | Aurora et al. | |
| 10,988,886 | B2 | 4/2021 | Jiang et al. | |
| 10,995,447 | B2 | 5/2021 | Beres et al. | |
| 11,008,691 | B2 | 5/2021 | Gernek et al. | |
| 11,021,832 | B2 | 6/2021 | Lee et al. | |
| 11,021,834 | B2 | 6/2021 | Ahamad et al. | |
| 11,028,514 | B2 | 6/2021 | Clara et al. | |
| 11,035,063 | B2 | 6/2021 | Alexander et al. | |
| 11,047,084 | B2 | 6/2021 | Clayton et al. | |
| 11,053,628 | B2 | 7/2021 | Alarcon et al. | |
| 11,060,224 | B2 | 7/2021 | Cannon et al. | |
| 11,066,774 | B2 | 7/2021 | Rios Acebal | |
| 11,105,033 | B2 | 8/2021 | Ayers et al. | |
| 2008/0053166 | A1 | 3/2008 | Lim | |
| 2010/0115784 | A1 | 5/2010 | Jo et al. | |
| 2015/0337483 | A1* | 11/2015 | Ramprasad | D06F 58/45 34/82 |
| 2018/0030645 | A1* | 2/2018 | Kulkarni | D06F 58/22 |
| 2022/0145508 | A1* | 5/2022 | Masters, Jr. | D06F 39/12 |
| 2023/0151536 | A1* | 5/2023 | Leibman | D06F 34/20 34/85 |

* cited by examiner

DRYER APPLIANCE AND COMPARTMENT FOR NON-TUMBLING ITEMS

FIELD

The present subject matter relates generally to dryer appliances and circulation of air for drying in compartments apart from the dryer drum.

BACKGROUND

Conventional dryer appliances are generally provided with a single chamber for drying articles. That chamber is typically defined by a rotating drum. This arrangement works well for articles such as clothing, sheets, towels, and other linens, where the rotation of the drum generates turnover of the articles, iteratively exposing different portions of the articles to air circulating through the drum.

However, it is undesirable to dry certain articles within a rotating drum. For example, articles with hard or semi-hard surfaces, such as shoes or boots, generate significant noise if introduced into a conventional dryer appliance as the soles of the shoes strike the surface of the tub when they are tossed by the rotating drum. On some occasions, such hard-surfaced articles may even damage elements of the drying appliance.

Additionally, such conventional dryers may be inappropriate vessels for drying articles intended to maintain a particular shape, for example, due to the deformation of the articles from tumbling in the drum or from being crushed by other articles in a particular load. Hats and caps provide an example of such articles. Although this concern may be alleviated with the use of rigid frames that protect the shaped article from deformation, the frames themselves become problematic due to the hard surfaces, again generating undesirable noise and potentially damaging the dryer appliance.

Accordingly, a dryer appliance with a secondary drying chamber that remains stationary during a drying cycle is desirable.

BRIEF DESCRIPTION OF THE INVENTION

Aspects and advantages of the invention will be set forth in part in the following description, or may be obvious from the description, or may be learned through practice of the invention.

An aspect of the present disclosure is directed to a dryer appliance including a cabinet, an air intake opening on a surface of the cabinet, an air exhaust opening on a surface of the cabinet, a drum defining a chamber for receipt of articles for drying, a first drawer forming a lint collection bin, and a second drawer. The cabinet may comprise an upper portion and a lower portion. The drum may be rotatably mounted within the upper portion of the cabinet. The drum may also comprise a drum air inlet and a drum air outlet, the drum air inlet in fluid communication with the air intake opening. The first drawer may be removable mounted in the lower portion of the cabinet, wherein the first drawer is in fluid communication with the drum air outlet and may further comprise a first drawer air outlet. The second drawer may be removably mounted below the drum and may be in fluid communication with the first drawer air outlet and the air exhaust opening.

Another aspect of the present disclosure is directed to a dryer appliance including a cabinet, an air intake opening on a surface of the cabinet, an air exhaust opening on a surface of the cabinet, a first fan for drawing air through the air intake opening, a second fan for pushing air out through the air exhaust opening, a drum defining a chamber for receipt of articles for drying, a first drawer forming a lint collection bin, and a second drawer. The cabinet may comprise an upper portion and a lower portion. The first fan may be mounted in the upper portion of the cabinet. The second fan may be mounted in the lower portion of the cabinet. The drum may be rotatably mounted within the upper portion of the cabinet. The drum may also comprise a drum air inlet and a drum air outlet, the drum air inlet in fluid communication with the air intake opening. The first drawer may be removable mounted in the lower portion of the cabinet, wherein the first drawer is in fluid communication with the drum air outlet and may further comprise a first drawer air outlet. The second drawer may be removably mounted below the drum and may be in fluid communication with the first drawer air outlet and the air exhaust opening.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
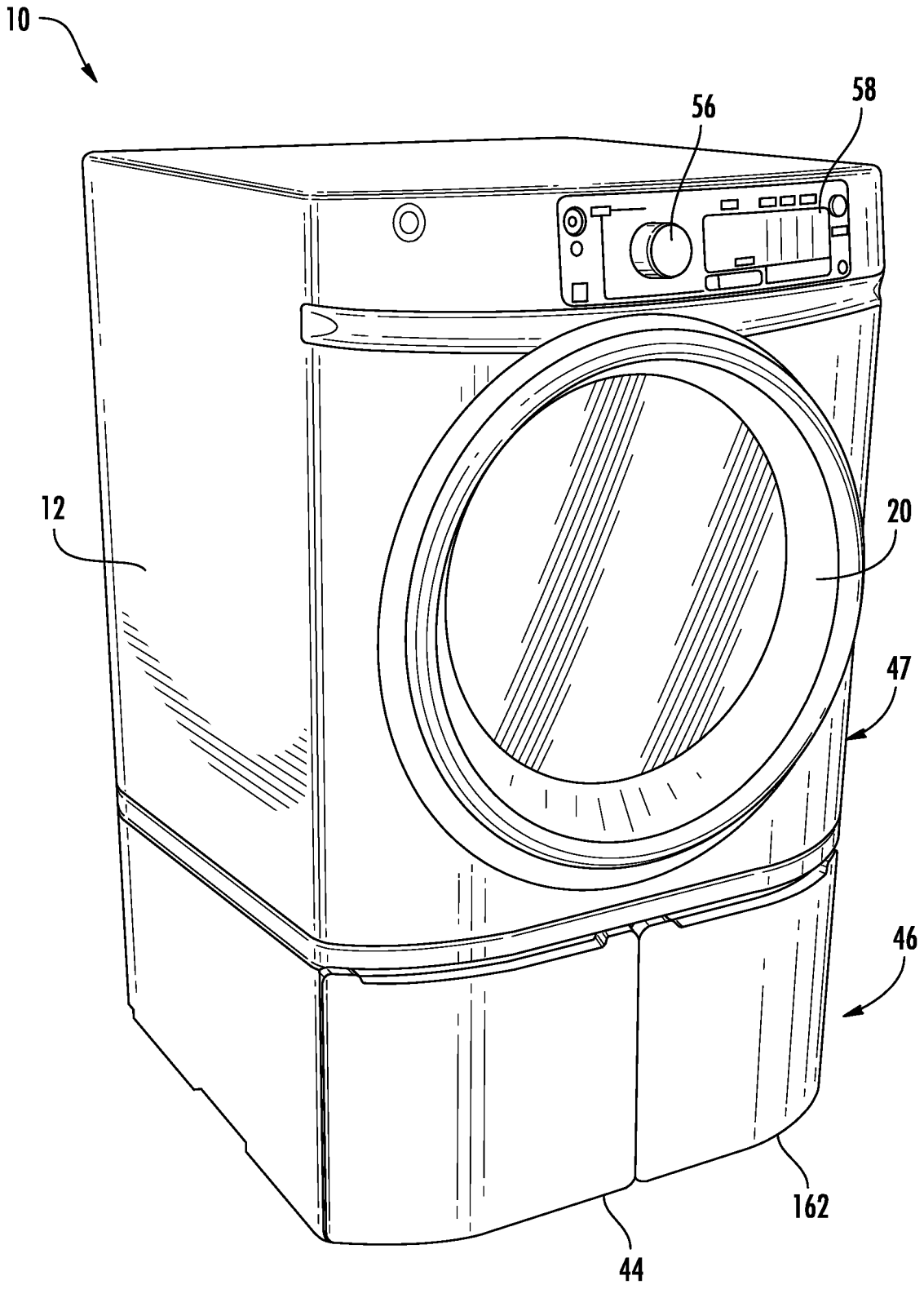
FIG. 1 is a perspective view of an embodiment of a dryer appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment.

Thus, it is intended that the present invention covers such modifications and variations as come within the scope of the appended claims and their equivalents.

Embodiments of a dryer appliance are provided including a removable, disposable, or replaceable filter assembly positionable within a cabinet. The filter assembly may be formed substantially similarly as filters for heating, ventilation, and air conditioning (HVAC) systems. Embodiments of the appliance may allow for increased time between filter cleanings, changes, or replacements. The increased time may correspond to intervals generally provided by filters for HVAC systems, e.g., up to approximately six months, or up to approximately three months, or up to approximately one month. Particular embodiments of the appliance provided herein may be configured as residential dryer appliances.

Embodiments provided herein may decrease risks associated fire or other damage related to clogged or unclean filters. Embodiments provided herein may obviate a need for cleaning and removing lint from a filter per use (e.g., dryer load or cycle operation) by a user, or per day by a user. The appliance with filter assembly provided herein may improve user interaction by increasing the interval between filter cleanings or replacements, allowing for standard replaceable filters (e.g., HVAC filters) in place of custom-sized filters at a dryer appliance, and allowing for improved airflow through the dryer appliance through larger filter areas.

Figure 2:
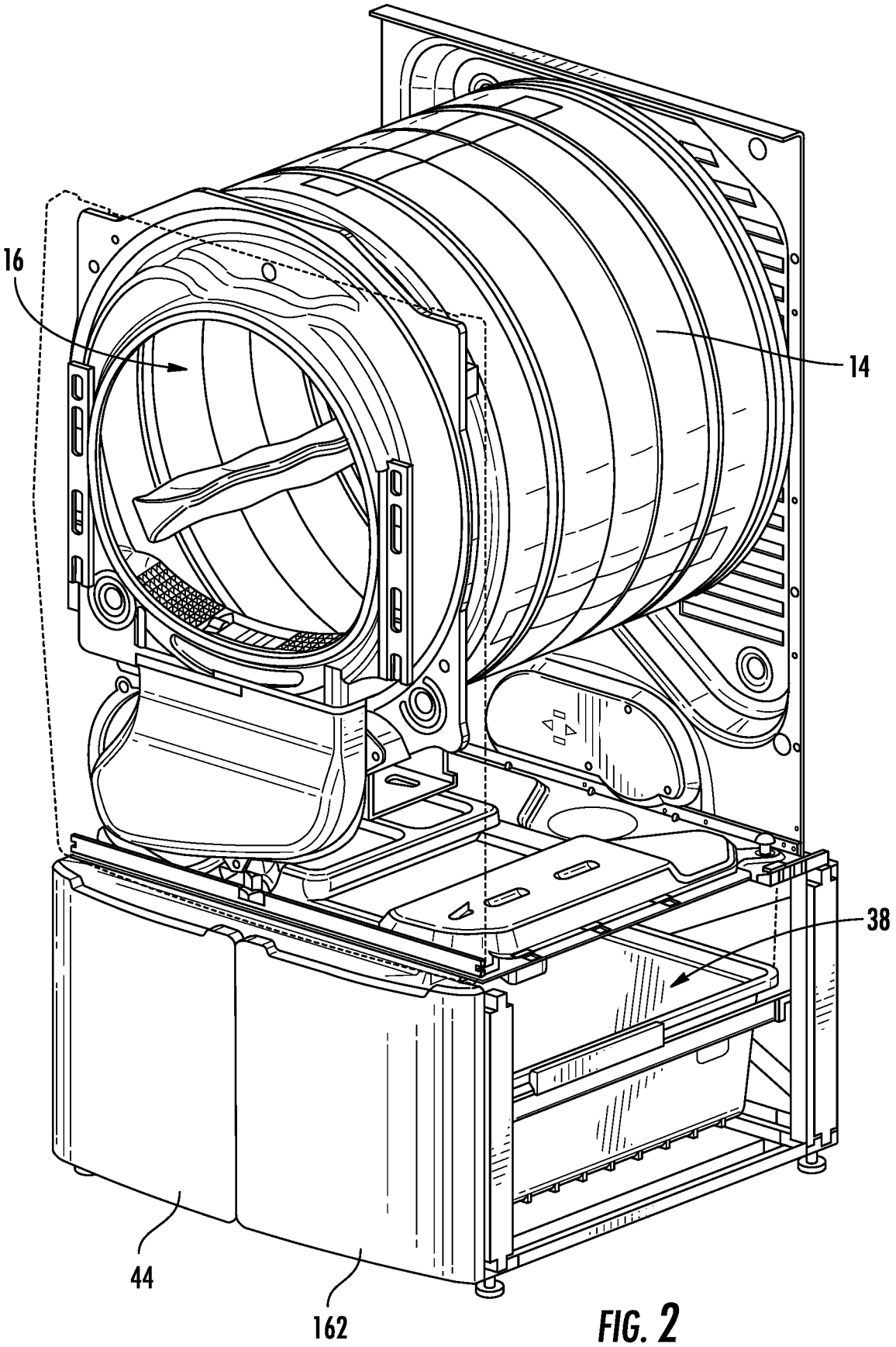
FIG. 2 is a partially see-through perspective view of an embodiment of the dryer appliance of FIG. 1 according to an exemplary embodiment of the present subject matter.

FIGS. 1 and 2 provide perspective views of a dryer appliance 10 according to an exemplary embodiment of the present subject matter. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For example, dryer appliance 10 illustrated in FIGS. 1 and 2 is an electric dryer appliance with electric heating element for heating air. In alternative exemplary embodiments, dryer appliance 10 may be a gas dryer appliance with gas burners for heating air.

Dryer appliance 10 includes a cabinet 12. Within cabinet 12 is a drum or container 14 (FIG. 2) mounted for rotation about a substantially horizontal axis. Drum 14 is generally cylindrical in shape and defines a chamber 16 for receipt of articles for drying. Thus, clothing articles and other fabrics may be loaded into chamber 16 of drum 14 and dried therein, as discussed in greater detail below. A door 20 is rotatably mounted to cabinet 12 to permit selective access to chamber 16 of drum 14.

Turning back to FIG. 1, dryer appliance 10 includes a cycle selector knob 56 mounted on a cabinet control panel 58. Cycle selector knob 56 and other control inputs of cabinet control panel 58 are in communication with a controller. Signals generated in the controller operate a drum motor and heater assembly in response to a position of selector knob 56. Alternatively, a touch screen type interface may be provided. The controller may include a memory and one or more microprocessors, CPUs or the like, such as general or special purpose microprocessors operable to execute programming instructions or micro-control code associated with operation of dryer appliance 10. The memory may represent random access memory such as DRAM, or read only memory such as ROM or FLASH. In one embodiment, the processor executes programming instructions stored in memory. The memory may be a separate component from the processor or may be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller may be positioned in a variety of locations throughout dryer appliance 10. For example, the controller may be located at, adjacent to, or integral to cabinet control panel 58 in cabinet 12. In such an embodiment, input/output ("I/O") signals may be routed between controller and various operational components of dryer appliance 10. As an example, the various operational components of dryer appliance 10 may be in communication with controller via one or more signal lines or shared communication buses.

Figure 3:
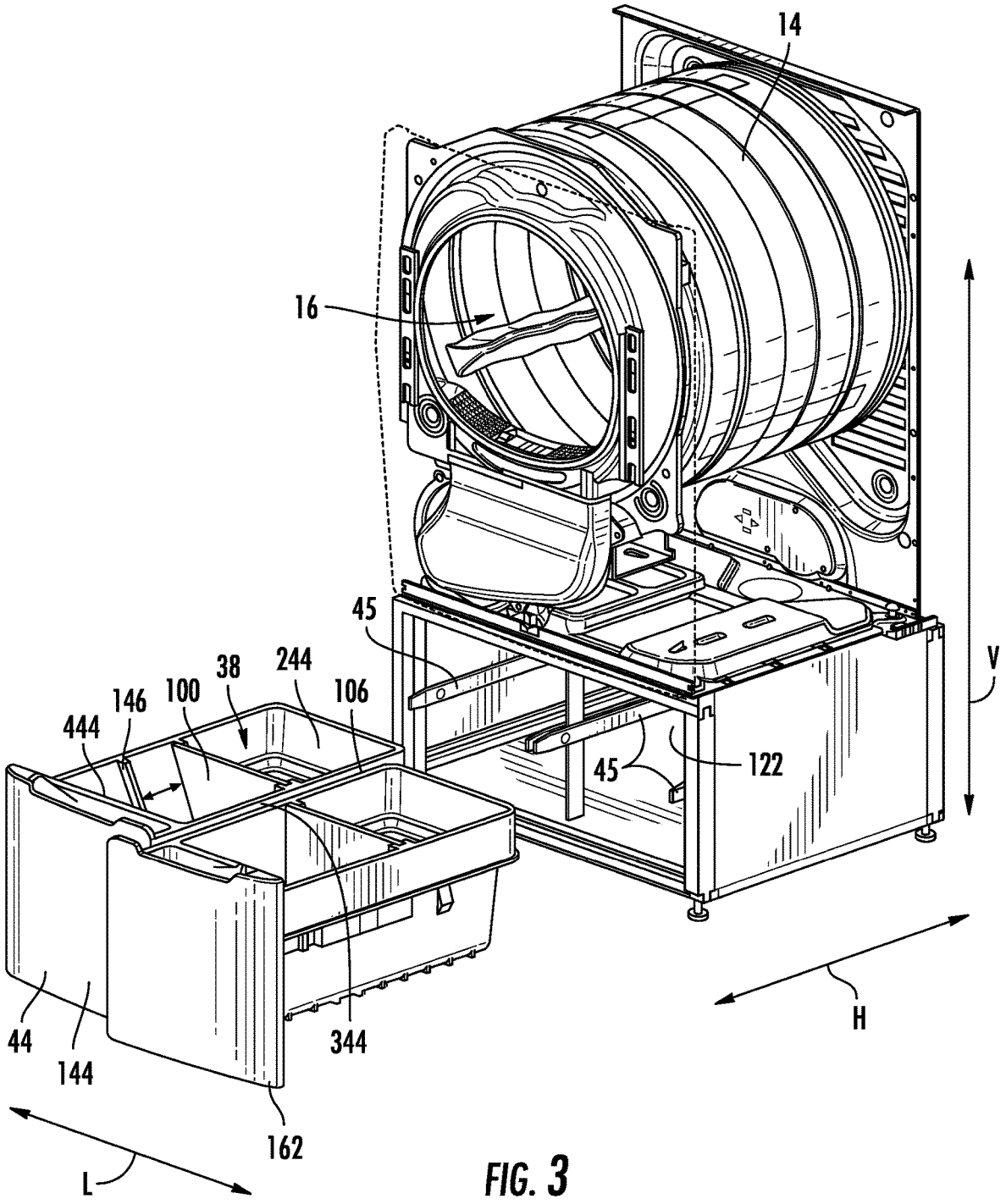
FIG. 3 is a partially see-through perspective view of an embodiment of the dryer appliance of FIGS. 1-2 with first and second drawers removed from the appliance, according to an exemplary embodiment of the present subject matter.

Cabinet 12 may be divided into a lower portion 46 and an upper portion 47. Although lower portion 46 and upper portion 47 of cabinet 12 are depicted in the embodiments of FIGS. 1-3 as physically separate or divided elements, in other embodiments, lower portion 46 and upper portion 47 of cabinet 12 may form a single unit. Furthermore, lower portion 46 and upper portion 47 need not be physically separated from one another, but rather may be consider upper and lower portions of drying appliance 10 only in a conceptual manner. Generally, however, upper portion 47 includes at least drum 14 and lower portion 46 is below drum 14.

A first drawer 44 is removably mounted to cabinet 12 at lower portion 46 of cabinet 12. First drawer 44 is adjustable (e.g., slidable) between a closed position (FIG. 1) and an open position (FIG. 3). In particular embodiments, the first drawer 44 is slidable along rails 45 extending within the cabinet 12 along a horizontal direction H. First drawer 44 includes front and rear walls 144, 244 and sidewalls 344, 444 extending between the front and rear walls 144, 244, together forming a lint collection bin 38. Lint collection bin 38 is configured for collecting and storing lint therein via a filter assembly 100. The filter assembly 100 is removably positionable within the lint collection bin 38. The filter assembly 100 is configured to filter air flowing through dryer appliance 10, such as discussed further herein.

Referring to FIG. 3, the filter assembly 100 is positionable between the front and rear walls 144, 244 and the sidewalls 344, 444. A track 146 is formed at the sidewalls 344, 444 and extending substantially along a vertical direction V. The track 146 forms a groove or slot through which the filter assembly 100 is selectively affixed within the first drawer 44.

A user of dryer appliance 10 may remove the filter assembly 100 from the first drawer 44 when the first drawer 44 is in the open position. With the filter assembly 100 removed from the first drawer 44, the user may clean or replace the filter assembly 100 and remove lint from within the first drawer 44. The user may adjust the first drawer 44 to return the filter assembly 100 to a suitable position for collecting lint during operation of dryer appliance 10. A poka-yoke arrangement between filter assembly 100 and first drawer 44 may assist with insuring that filter assembly 100 is properly or suitably positioned within first drawer 44 to capture lint during operation of dryer appliance 10.

Various embodiments of the filter assembly 100 include a filter element formed of any suitable filter material, including fiberglass, polyester, or cotton, or combinations thereof, suspended in a frame 106 (FIG. 3). The frame 106 may be formed of a paper-based material, cardboard, wire or wire-mesh material, metal or metallic material, rubber or synthetic rubber, or combinations thereof. The frame 106 may be configured to be deformable, such as to allow the filter assembly 100 to compress or fit against a lower panel 122, the track 146, and the lower wall 544 when the drawer 44 is in the closed position, such as to limit or eliminate a flow of air between one or more respective surfaces and the frame 106 and promote airflow through the filter element. In alternative embodiments, first drawer 44 may include a floor (not pictured) against which filter assembly 100 may abut when filter assembly 100 is inserted into first drawer 44.

Embodiments of the appliance 10 provided herein may allow for air filters generally used for residential or commercial heating, ventilation, or air conditioning (HVAC) systems to be used at the appliance 10. The drawer 44 may be sized to correspond to one or more standard air filter sizes for HVAC systems.

Figure 6:
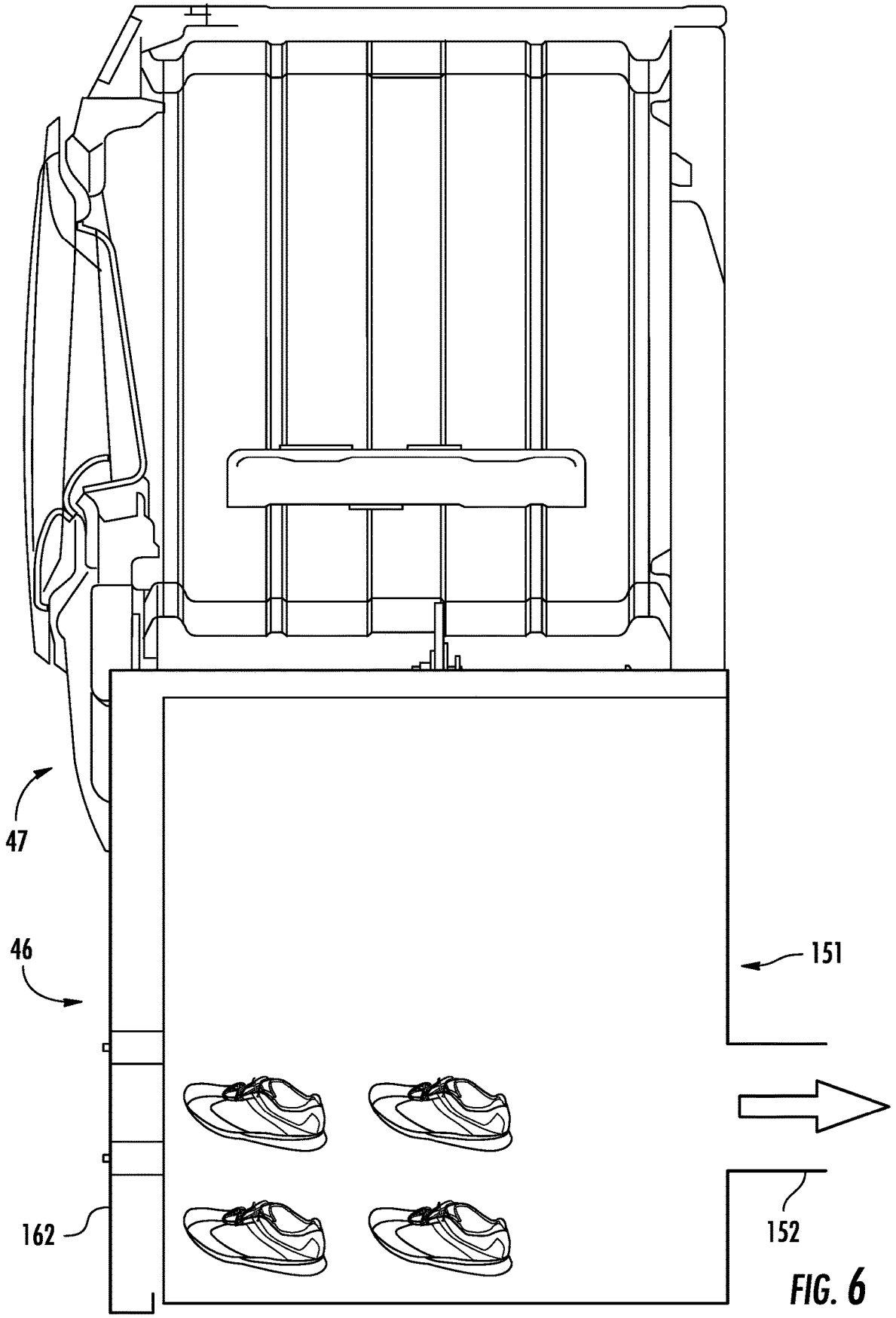
FIG. 6 is a side cross-sectional view of an embodiment of the dryer appliance according to an exemplary embodiment of the present subject matter.

A second drawer 162 is also removably mounted to cabinet 12 at lower portion 46 of cabinet 12. In the embodiment of FIG. 3, second drawer 162 is also mounted in the lower portion 46 of cabinet 12 and beside first drawer 44 in the lateral direction. One of ordinary skill will understand that this arrangement is not required, however. For example, in alternative embodiments, first drawer 44 and second drawer 162 may be stacked vertically. In still other embodiments, second drawer 162 may be larger than first drawer 44 and may extend into the upper portion 47 of cabinet 12, providing additional space for items to be dried therein (FIG. 6). In such embodiments, at least a portion of second drawer 162 is situated in lower portion 46 of cabinet 12 and at least a portion of second drawer 162 is situated in upper portion 47 of cabinet 12.

Like, first drawer 44, second drawer 162 is adjustable (e.g., slidable) between a closed position (FIG. 1) and an open position (FIG. 3). In particular embodiments, second drawer 162 is slidable along rails 45 extending within the cabinet 12 along a horizontal direction H. Second drawer 162 may generally include front and rear walls, sidewalls, and a floor, thus forming a drying chamber for the drying of articles placed therein. In certain alternative embodiments, second drawer 162 may also include a ceiling such that second drawer 162 is fully enclosed, except for air flow passages, 6as otherwise indicated herein.

A user of dryer appliance 10 may insert or remove item for drying, such as shoes, boots, hats, and the like, from the second drawer 162 when the second drawer 162 is in the open position. Second drawer 162 may be entirely empty in certain embodiments. In other embodiments, shelves, hooks, posts, and/or other such elements may be present to accommodate placement and spacing of the articles for drying.

Figure 4A:
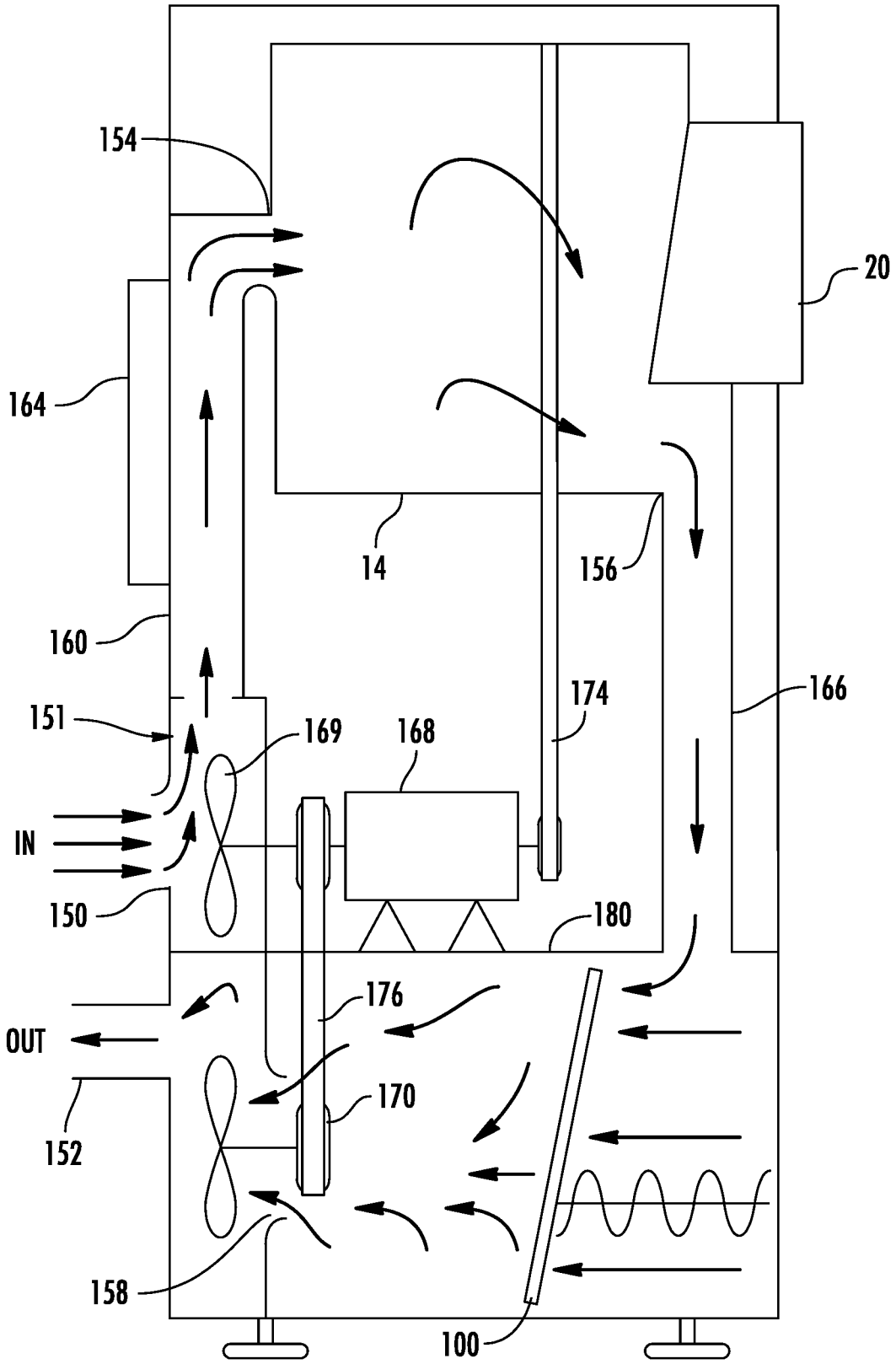
FIG. 4A is a side cross-sectional view of an embodiment of the dryer appliance according to an exemplary embodiment of the present subject matter.

FIG. 4A provides a side view of certain components of dryer appliance 10. Dryer appliance 10 includes an air intake opening 150 on a surface 151 of cabinet 12. In the embodiment of FIG. 4A, a first fan 168 is mounted within upper portion 47 of cabinet 12. First fan 168 is configured to draw ambient air in through air intake opening 150 and into a first air duct 160, which is attached at one end to air intake open 150, for delivery to drum 14, as described herein. First fan 168 further comprises a first fan impeller 169, which is disposed within first air duct 160. A first fan belt 174 drives rotation of first fan 168. First fan belt 174 attaches at one end to first fan 168 and at the other end around drum 14. In this way, rotation of drum 14 drives operation of first fan 168. The difference in diameter between drum 14 and a rotating element (not pictured) of first fan 168 also ensures that the first fan impeller 169 at substantially higher rate of rotation than drum 14. One of ordinary skill in the art will recognize that the rate of rotation of impeller 169, and thus the air flow rate through the system, can be controlled by the adjusting the relative diameters of the drum 14 and the rotating element of the first fan 168. First air duct 160 is a duct in the preferred embodiment, but one of ordinary skill in the art will recognize that first air duct 160 could, in alternative embodiments, take the form of one or more of a tube, pipe, conduit, or any other known manner for guiding air from one point to another.

As previously explained, drum 14 is rotatably mounted within upper portion 47 of cabinet 12. A rear wall of drum 14 may be rotatably supported within cabinet 12 by a suitable fixed bearing. A drum motor (not pictured) rotates the drum 14 about a horizontal axis. For example, the drum motor may be coupled to drum 14 via a pulley and belt system or the drum motor may be directly coupled to drum 14 and directly drive drum 14. Drum 14 further includes a drum air inlet 154 and a drum air outlet 156. Drum air inlet 154 is in fluid communication with air intake opening 150 and is attached to an end of first air duct 160.

Drum 14 is configured to receive heated air that has been heated by a heater assembly 164, e.g., in order to dry damp articles disposed within chamber 16 of drum 14. During operation of dryer appliance 10, drum 14 rotates and first fan 168 circulates air through first air duct 160 and chamber 16 of drum 14. In particular, ambient air enters or passes by heater assembly 164 in a conventional manner due to first fan 168 urging such ambient air into or by heater assembly 164. Ambient air is heated by heater assembly 164 and continues as heated air through first air duct 160. First fan 168 then circulates such heated air through drum air inlet 154 and into drum 14. The heated air passed through drum 14 and exits through drum air outlet 156.

Drum air outlet 156 is attached to an upstream end of a second air duct 166. Second air duct 166 is a duct in the preferred embodiment, but one of ordinary skill in the art will recognize that second air duct 166 could, in alternative embodiments, take the form of one or more of a tube, pipe, conduit, or any other known manner for guiding air from one point to another.

Figure 4B:
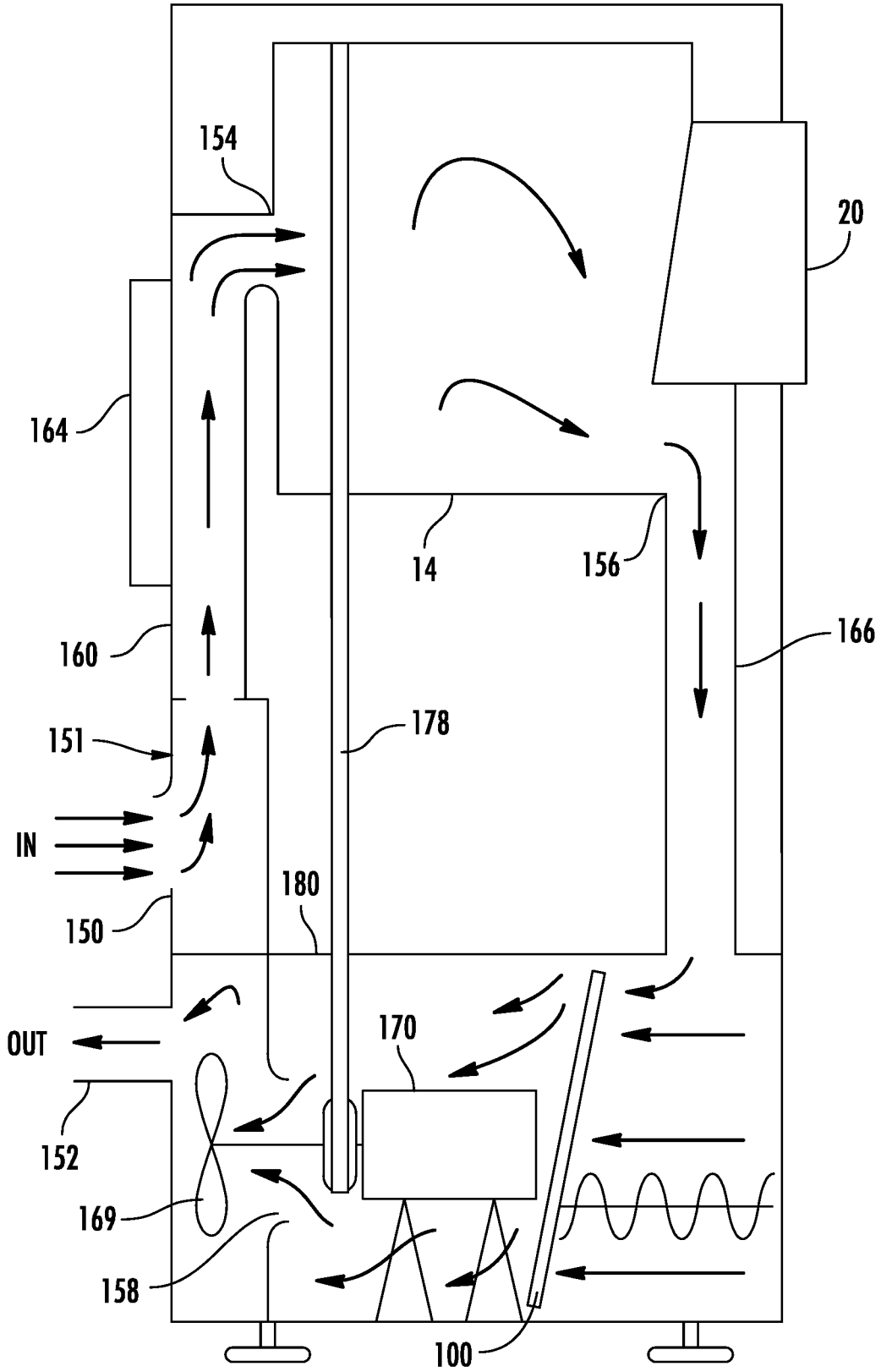
FIG. 4B is a side cross-sectional view of an embodiment of the dryer appliance according to an exemplary embodiment of the present subject matter.

First drawer 44 is situated directly below a downstream end of second air duct 166. In the embodiments of FIGS. 4A and 4B, the downstream end of second air duct 166 forms an opening in a divider 180, wherein divider 180 physically separates the upper portion 47 of cabinet 12 from the lower portion 46 of cabinet 12. In these embodiments, divider 180 also forms a ceiling enclosing first drawer 44, with the exception of the opening provided by second air duct 166. In this way, air passing through second air duct 166 is directed into first drawer 44. It will be recognized that the physical relationship between second air duct 166 and first drawer 44, as depicted in FIGS. 4A and 4B is not required to practice the present subject matter. In alternative embodiments, divider 180 may be omitted entirely and first drawer 44 may include a ceiling panel with an opening situated at the downstream end of second air duct 166 when first drawer 44 is in the closed position, thereby permitting air to flow from second air duct 166 to first drawer 44. More generally, the present subject matter is intended to include any physical relationship in which first drawer 44 is in fluid communication drum air outlet 156.

First drawer 44 further includes a first drawer air outlet 158 on rear wall 244 of drawer 44. As previously explained, first drawer 44 further includes filter assembly 100. Filter assembly 100 is situated upstream of first drawer air outlet 158. After heated air that has passed through drum 14 is introduced to first drawer 44, it travels toward first drawer air outlet 158 and through filter assembly 100, which traps lint and removes lint particles from the lint and moisture laden air. The lint may generally be captured at an upstream side of the filter assembly 100.

As a result of the reduction in air pressure resulting of passage of air from air intake opening 150 to first drawer air outlet 158, and through filter assembly 100 in particular, dryer appliance 10 may further include a second fan 170 in the lower portion 46 of cabinet 12, as shown in the embodiment of FIG. 4A. Specifically, second fan 170 may be situated downstream of filter assembly 100 to circulate air into second drawer 162 and through an air exhaust opening 152, as further described herein. A second belt 176 may be connected between first fan 168 and second fan 170, as shown in FIG. 4A. In this way, rotation of drum 14 drives rotation of first fan 168, which in turn drives rotation of second fan 170. Once again, one of ordinary skill in the will recognize that adjustment of the relative diameters at the point of attachment of second belt 176 to first fan 168 and the second fan 170 allows for control of the rate of rotation of the second fan 170.

Although the present disclosure is described in the context of the physical arrangement of the embodiment of FIG. 4A, alternative embodiments, such as that shown in FIG. 4B are intended to fall within the scope of the present disclosure. As shown in FIG. 4B, only a single fan is included in dryer appliance 10. Specifically, in this embodiment, second fan 170 alone circulates air from air intake opening 150 to air exhaust 152. In this embodiment, a third belt 178 is connected on one end to second fan 170 and on the other end around drum 14, thus allowing the rotation of drum 14 to drive rotation of second fan 170 and allowing for control over the rate of rotation based on relative diameters at the points of connection of third belt 178, in the manner previously described. In other embodiments, first fan 168 is employed alone with impeller 169 in first air duct 160. In still other embodiments, first fan 170 is employed alone and impeller 169 is situated in second duct 166. In yet other embodiments, different arrangements of first belt 174, second belt 176, and/or third belt 178 may be employed. For example, in certain embodiments including both first fan 168 and second fan 170, only third belt 178 may be employed, connecting all of drum 14, first fan 168, and second fan 170. One of ordinary skill in the art will recognize other alternative arrangements intended to fall within the scope of the present disclosure.

Figure 5:
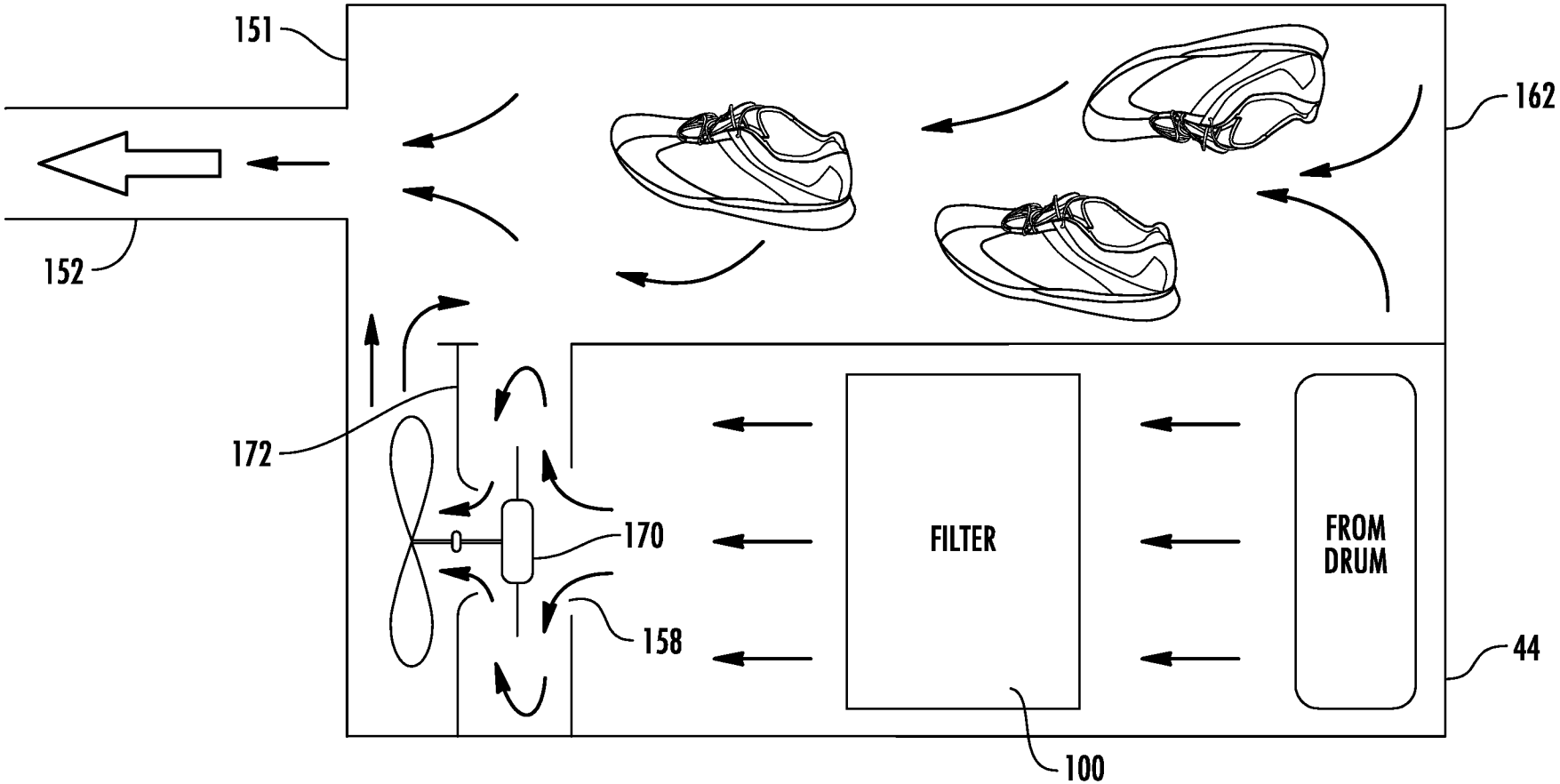
FIG. 5 is a top cross-sectional view of the first and second drawers of an embodiment of the dryer appliance according to an exemplary embodiment of the present subject matter.

Referring now to the top view shown in FIG. 5, second drawer 162 is in fluid communication with first drawer air outlet 158. Accordingly, filter air flowing from first drawer 44 is directed into second drawer 162 for drying of articles therein. Air may be directed from first drawer air outlet 158 via a plenum, duct, conduit, pipe, tube, or any other known air transport means. In some embodiments, as shown in FIG. 5, a guide element 172 may be positioned downstream of first drawer air outlet 158 to aid in directing air to second drawer 162. Guide element 172 may be any rigid or semi-rigid component for impeding and redirecting air flow. In one embodiment, guide element 172 may be a planar sheet oriented parallel to first drawer air outlet 158 against which air collides, generating turbulence that emanates away from first drawer 44 and toward and into second drawer 162. In another embodiment, guide element 172 may be planar and oriented at angle to funnel air toward second drawer 162. In still another embodiment, guide element 172 may be curved such that air travels along the surface of guide element 172, turning in the direction of second drawer 162. In yet other embodiments, guide element 172 may be a conduit, pipe, tube, or the like with an outlet directed toward second drawer 162.

After travelling through second drawer 162, air may exit dryer appliance 10 through air exhaust opening 152 (i.e., second drawer 162 is in fluid communication with air exhaust opening 152. Air exhaust opening 152 may be situated on surface 151 of cabinet 12. As shown in the embodiments of FIGS. 4A and 4B, air intake opening 150 and air exhaust opening 152 may be on the same surface 151 of cabinet 12, but such is not required. Indeed, in alternative embodiments, air intake opening 150 and air exhaust opening 152 may be on separate surfaces of cabinet 12.

Air exhaust opening 152 may also be offset from first drawer air outlet 158 in one or more of the lateral and vertical directions. This placement may vary depending upon the physical relationship between first drawer 44 and second drawer 162 (e.g., side-by-side or vertically stacked). Offsetting air exhaust opening 152 from first drawer air outlet 158 discourage air passing out of first drawer 44 from exiting through air exhaust opening 152 without first circulating through second drawer 162. The arrangement further generates air turbulence, which aids in circulating air through second drawer 162 and drying the articles therein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet comprising an upper portion and a lower portion;

an air intake opening on a surface of the cabinet;

an air exhaust opening on the surface of the cabinet;

a drum rotatably mounted within the upper portion of the cabinet, the drum defining a chamber for receipt of articles for drying and comprising a drum air inlet and a drum air outlet, the drum air inlet in fluid communication with the air intake opening;

a first drawer removably mounted in the lower portion of the cabinet, the first drawer forming a lint collection bin, wherein the first drawer is in fluid communication with the drum air outlet and further comprises a first drawer air outlet; and a second drawer removably mounted below the drum, the second drawer in fluid communication with the first drawer air outlet and further in fluid communication with the air exhaust opening.

2. The dryer appliance of claim 1 further comprising a first air duct connecting the air intake opening and the drum air inlet.

3. The dryer appliance of claim 2 further comprising a heater in proximity to the first air duct for heating air traveling from the first air duct to the drum air inlet.

4. The dryer appliance of claim 3 further comprising a second air duct providing a path between the drum air outlet to the first drawer.

5. The dryer appliance of claim 1, wherein the first drawer further comprises a filter assembly removably positionable within the lint collection bin.

6. The dryer appliance of claim 1 further comprising a first fan for circulating air from the air intake opening to the air exhaust opening.

7. The dryer appliance of claim 5 further comprising a first fan situated upstream of the filter assembly and a second fan situated downstream of the filter assembly, the first fan and the second fan for circulating air from the air intake opening to the air exhaust opening.

8. The dryer appliance of claim 1, wherein the air exhaust opening is offset from the first drawer air outlet in one or more of the lateral and vertical directions.

9. The dryer appliance of claim 1 further comprising a guide element positioned downstream of the first drawer air outlet for motivating air into the second drawer.

10. The dryer appliance of claim 1, wherein at least a portion of the second drawer is situated in the lower portion of the cabinet and at least a portion of the second drawer is situated in the upper portion of the cabinet.

11. The dryer appliance of claim 1, wherein the first drawer and the second slide in the lateral direction between an open position and a closed position.

12. A dryer appliance, comprising:

a cabinet comprising an upper portion and a lower portion;

an air intake opening on a surface of the cabinet;

an air exhaust opening on the surface of the cabinet;

a first fan in the upper portion of the cabinet for drawing air in through the air intake opening;

a second fan in the lower portion of the cabinet for pushing air out through the air exhaust opening;

a drum rotatably mounted within the upper portion of the cabinet, the drum defining a chamber for receipt of articles for drying and comprising a drum air inlet and a drum air outlet, the drum air inlet in fluid communication with the air intake opening;

a first drawer removably mounted in the lower portion of the cabinet, the first drawer forming a lint collection bin, wherein the first drawer is in fluid communication with the drum air outlet and further comprises a first drawer air outlet; and a second drawer removably mounted below the drum, the second drawer in fluid communication with the first drawer air outlet and further in fluid communication with the air exhaust opening.

13. The dryer appliance of claim 12 further comprising a first air duct connecting the air intake opening and the drum air inlet.

14. The dryer appliance of claim 13 further comprising a heater in proximity to the first air duct for heating air traveling from the first air duct to the drum air inlet.

15. The dryer appliance of claim 14 further comprising a second air duct providing a path between the drum air outlet to the first drawer.

16. The dryer appliance of claim 12, wherein the first drawer further comprises a filter assembly removably positionable within the lint collection bin.

17. The dryer appliance of claim 12, wherein the air exhaust opening is offset from the first drawer air outlet in one or more of the lateral and vertical directions.

18. The dryer appliance of claim 12 further comprising a guide element positioned downstream of the first drawer air outlet for motivating air into the second drawer.

19. The dryer appliance of claim 12, wherein at least a portion of the second drawer is situated in the lower portion of the cabinet and at least a portion of the second drawer is situated in the upper portion of the cabinet.

20. The dryer appliance of claim 12, wherein the first drawer and the second slide in the lateral direction between an open position and a closed position.

* * * * *